United States Patent [19]

Amataka et al.

[11] Patent Number: 4,955,353

[45] Date of Patent: Sep. 11, 1990

[54] PISTON FOR INTERNAL COMBUSTION ENGINE

[75] Inventors: Atsushi Amataka; Kazumitsu Kushida, both of Tokyo; Koji Nakajima; Hitoshi Yamamoto, both of Saitama, all of Japan

[73] Assignee: Honda Giken Kogyo Kabushiki Kaisha, Tokyo, Japan

[21] Appl. No.: 239,763

[22] Filed: Sep. 2, 1988

[30] Foreign Application Priority Data

Sep. 11, 1987 [JP] Japan ..... 62-227788

[51] Int. Cl.[5] ..... F02B 75/08

[52] U.S. Cl. ..... 123/668; 123/193 P; 92/224

[58] Field of Search ..... 123/668, 669, 193 P, 123/193 CP; 92/213, 222, 223, 224

[56] References Cited

U.S. PATENT DOCUMENTS

| | | | |
|---|---|---|---|
| 2,606,085 | 8/1952 | Kiekhaefer | 277/137 |
| 2,926,649 | 3/1960 | Hicks | 123/668 |
| 3,906,923 | 9/1975 | Harker | 123/193 CP |
| 4,711,208 | 12/1987 | Soader et al. | 123/669 |

FOREIGN PATENT DOCUMENTS

| | | | |
|---|---|---|---|
| 102772 | 12/1937 | Australia | 92/223 |
| 2921952 | 12/1980 | Fed. Rep. of Germany | 123/668 |
| 196482 | 6/1967 | U.S.S.R. | 92/222 |

*Primary Examiner*—Noah P. Kamen
*Attorney, Agent, or Firm*—Lyon & Lyon

[57] ABSTRACT

A piston head for an internal combustion engine is provided containing a polished nickel plated layer formed in the piston top and an anodized layer formed on at least the lower part of the uppermost piston ring groove in order to reduce the adverse affects of excessive thermal conditions on the member.

12 Claims, 7 Drawing Sheets

PISTON FOR INTERNAL COMBUSTION ENGINE

BACKGROUND OF THE INVENTION

The present invention relates to a piston for an internal combustion engine and, more particularly, to a piston having improved heat resistance.

Recently, piston heat load has become more severe as improvement in performance occurs in internal combustion engines. Particularly, the heat load is great during engine operation at high speed under partial load, and abnormal combustion or detonation tends to occur. Abnormal combustion is generated by self ignition at the piston top at high temperatures prior to, or simultaneously with, ignition by the ignition plug in the compression stroke, causing roughness of the surface of the piston head. Abnormal combustion tends to occur particularly at the squish area, and accordingly, the roughness of the surface so-created adversely effects engine performance.

To protect the piston head, it has been proposed that the piston head be covered with an iron plated layer (Japanese Utility Model Laid-Open Publication No. 57-28147) or a nickel plated layer (Japanese Patent Laid-Open Publication No. 55-78856), for example.

Although damage to the piston head due to abnormal combustion is eliminated by forming such plated layers on the piston head, another problem exists. That is, the improvement in heat resistance of the piston head has permitted the us of the piston under even more severe thermal conditions. As a result, where measures to provide heat resistance have not been taken, surface roughening due to high temperature is generated between the topmost of the piston rings and the groove for receiving the top ring. Consequently, the top ring cannot perform adequately.

Accordingly, it is an object of the present invention to provide a piston for an internal combustion engine which eliminates surface roughening at the top of the piston and at the top ring groove, thereby rendering the piston applicable to high-output engines subject to high combustion temperatures.

SUMMARY OF THE PRESENT INVENTION

According to the present invention, a nickel plated layer having a predetermined thickness is formed on the piston top, and an anodized layer is formed by anodic oxide coating or anodizing on at least a part of the lower surface of the top ring groove.

The nickel plated layer is preferably formed by an electroless procedure from the viewpoint that the thickness of the plated layer at an edge portion can be made substantially equal to that at the other portion. The thickness of the nickel plated layer is preferably 20 to 30 micrometers (microns). If the thickness is less than 20 micrometers, the protective effect is insufficient, and if the thickness is more than 30 micrometers, the protective effect is sufficient, but the plating time is disadvantageously increased. The nickel plated layer need not necessarily be formed on the entire surface of the piston top, since the invention is effective when the plated layer is formed only at the portion of the piston top opposite the squish area.

The thickness of the anodized layer is preferably about 10 micrometers. If the thickness is too large, the anodized layer is prone to separate from the base material. It is sufficient according to practice of the invention that the anodized layer be formed only on part of the lower surface of the top ring groove. In the case of two-cycle engines, it is sufficient that the anodized layer be formed at the portion of the top ring groove opposed to the exhaust port where hot exhaust gases occur. Of course, the anodized layer may be formed on the entire lower surface of the top ring groove, or, alternatively, it may be formed on the entire upper and lower surfaces of the top ring groove.

With the described arrangement, surface roughening of the piston top due to abnormal combustion, or the like, is prevented by the nickel plated layer. On the other hand, surface roughening of the top ring groove due to the high load, or the like, is prevented by the anodized layer. Thusly, the piston of the present invention can be adapted to high performance engines.

For a better understanding of the invention, its operating advantages and the specific objectives obtained by its use, reference should be made to the accompanying drawings and description which relate to preferred embodiments thereof.

DESCRIPTION OF THE PREFERRED EMBODIMENTS OF THE INVENTION

Figure 1:
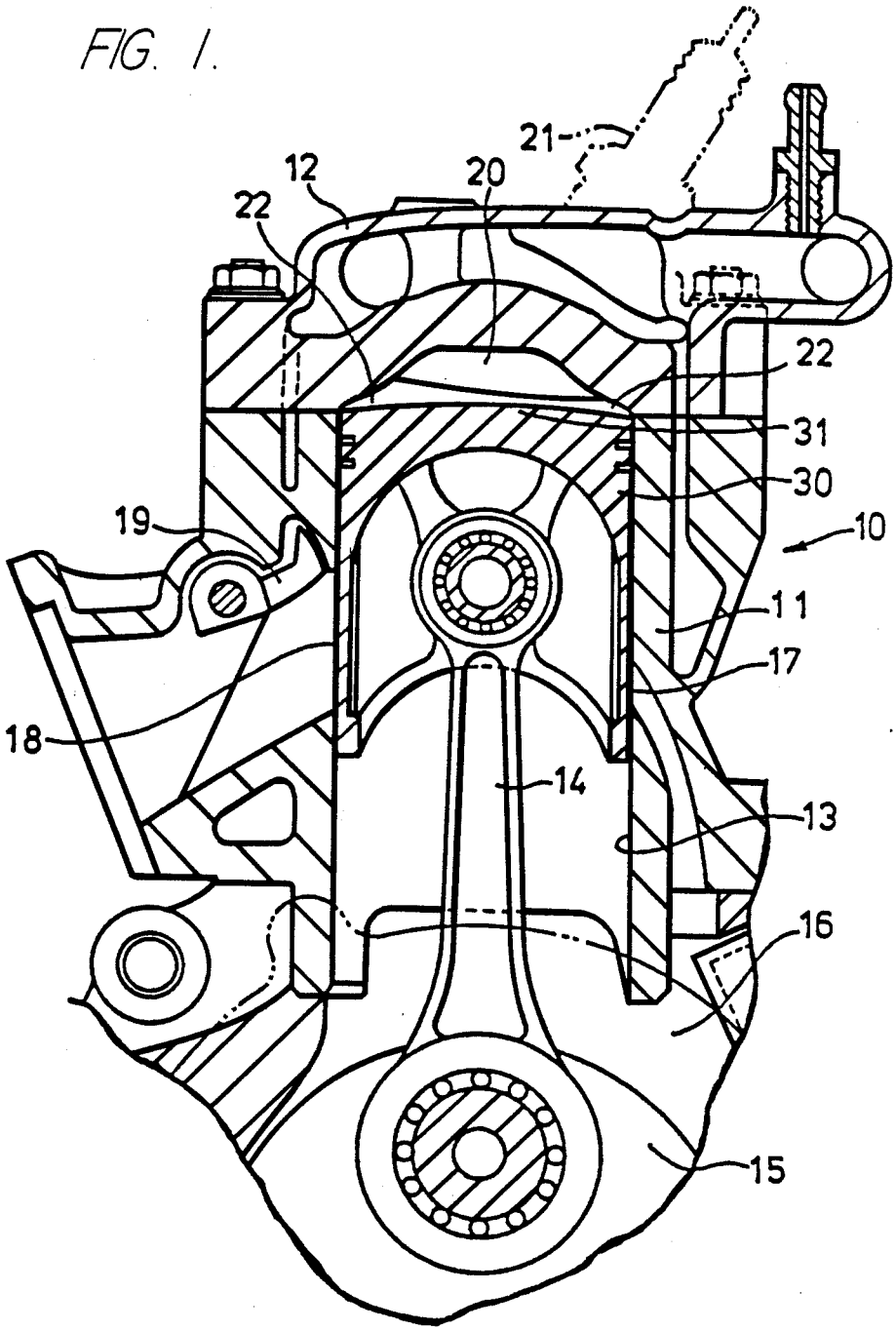
FIG. 1 is a vertical sectional view of a first embodiment of the present invention applied to a two-cycle engine.

Referring now to FIG. 1, which shows part of a two-cycle engine 10 employing a piston according to the present invention, the cylinder head 12 is fixedly mounted on the cylinder block 11 of the engine. The piston 30 is axially slidably fitted in the cylinder 13 formed in the cylinder block 11. The piston 30 is driven by a crankshaft 15 through a piston rod 14. A scavenging port 17 is opened at the mid-position of the cylinder 13 and is communicated with the crank case 16 housing the crankshaft 15. An exhaust port 18 for discharging exhaust gas is also opened into the cylinder 13. An exhaust valve 19 is provided in the exhaust port 18 to vary the exhaust timing according to engine speed.

Figure 2:
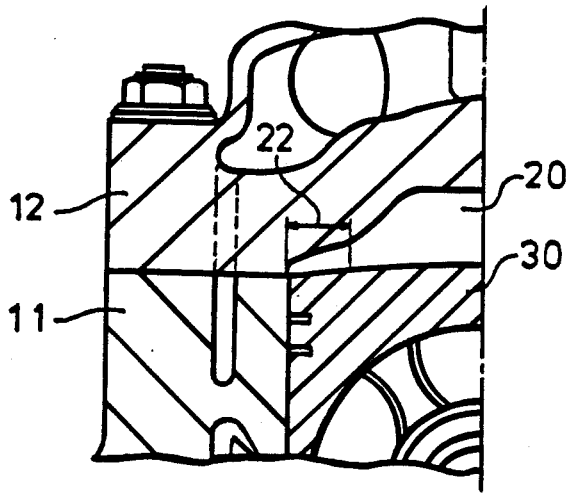
FIG. 2 is an enlarged sectional view of an essential portion of the engine of FIG. 1.

A combustion chamber 20 is formed in the cylinder head 12 in opposed relationship to the top 31 of the piston 30. An ignition plug 21 is located at the central upper portion of the combustion chamber 20. As also shown in FIG. 2 in enlarged section, a squish area 22 is formed at the peripheral edge portion of the combustion chamber 20. The "squish area" is a localized region of the combustion chamber that may be formed as shown in FIG. 2 of reduced volume in order, in cooperation with the piston during the compression stroke, to collect the fuel mixture and compress it to an elevated pressure in the region of the ignition plug for enhancing its ignitability.

Figure 3A:
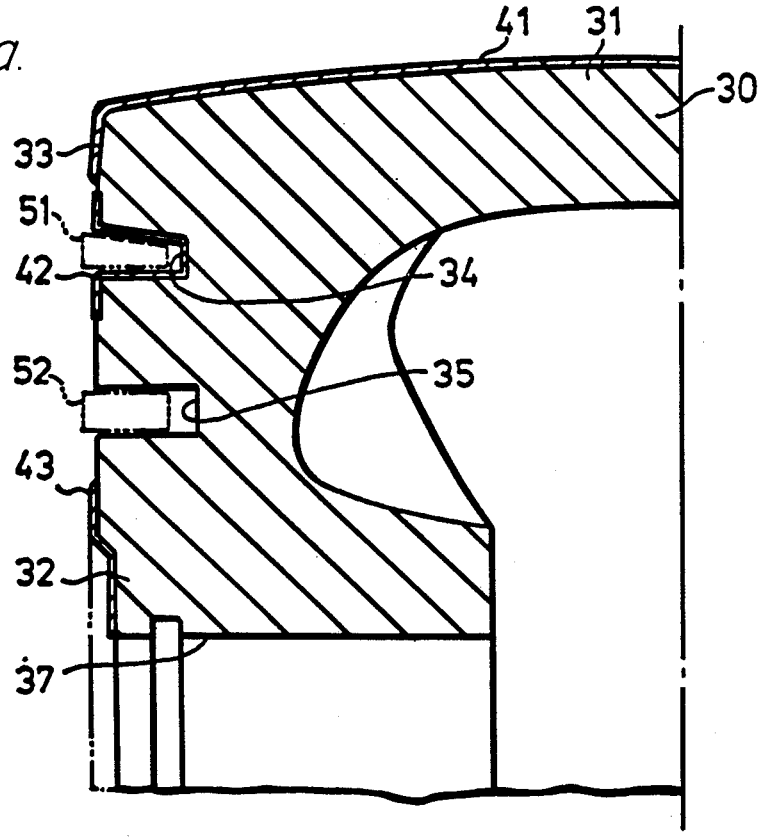
FIG. 3A is an enlarged sectional view of an essential part of the piston shown in FIG. 1.
Figure 3B:
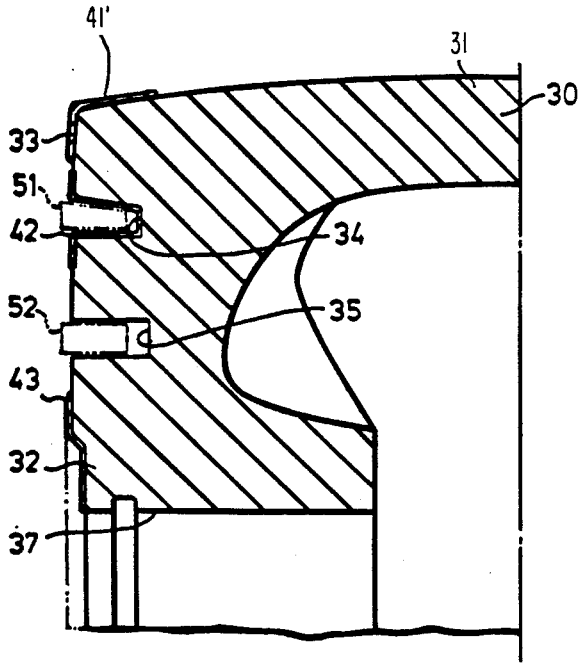
FIG. 3B is a view similar to FIG. 3A illustrating a second embodiment of the invention.

As shown in FIG. 3A in enlarged section, the piston 30 is so machined as to form a tapering circumferential surface 33 at the piston top 31 and provide an outer diameter slightly smaller than that of the skirt portion 32. A nickel plated layer 41 having a predetermined thickness, e.g., a thickness of about 20 to 30 micrometers is formed by electroless plating to cover a portion of the tapering surface 33 and the entire surface of the piston top 31. By means of the electroless nickel plating process, the surface roughness of the piston top 31 is controlled to be less than 6.3 S, so as to suppress the generation of abnormal combustion. As illustrated in FIG. 3B, the nickel plated heat registry layer, indicated as 41' can be limited in extent to only the annular region of the piston top 31 that is subject to the squish area of the combustion chamber 20 as shown at 22 in FIG. 2.

A top ring groove 34 for receiving the top ring 51 is formed on the sid wall of the piston 30 at a position just below the piston top 31. A second ring groove 35 for receiving a second ring 52, such as an expander, is also formed on the side wall of the piston 30 at a position a predetermined distance below the top ring groove 34. An anodized layer 42 having a predetermined thickness, e.g., a thickness of about 10 micrometers is formed by anodic oxide coating or anodizing on the surface of the top ring groove 34. Further, a tin plated layer 43 having a predetermined thickness is formed on the circumferential surface of the skirt portion 32 just below the second ring groove 35, so as to reduce sliding resistance of the piston against the cylinder 13. The thickness of the tin plated layer 43 may be similar to a normal thickness in the prior art.

Figure 4A:
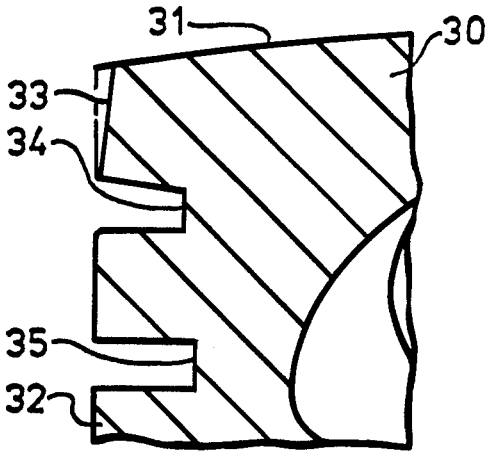
FIGS. 4(A) to 4(D) are views illustrating the manufacturing steps employed in production of the piston of the first embodiment.
Figure 4B:
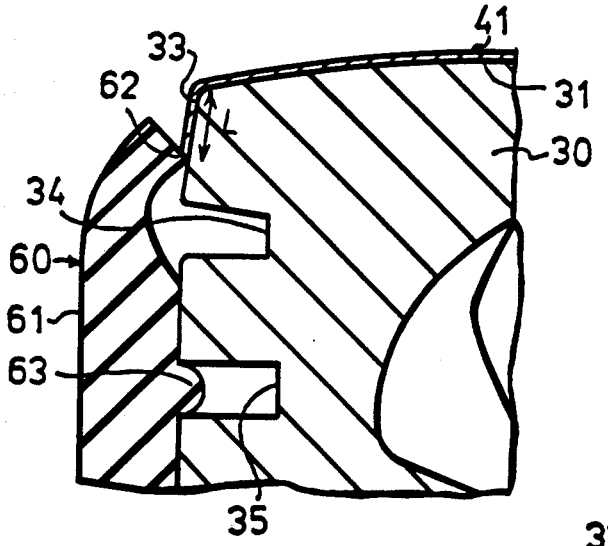
Figure 4D:
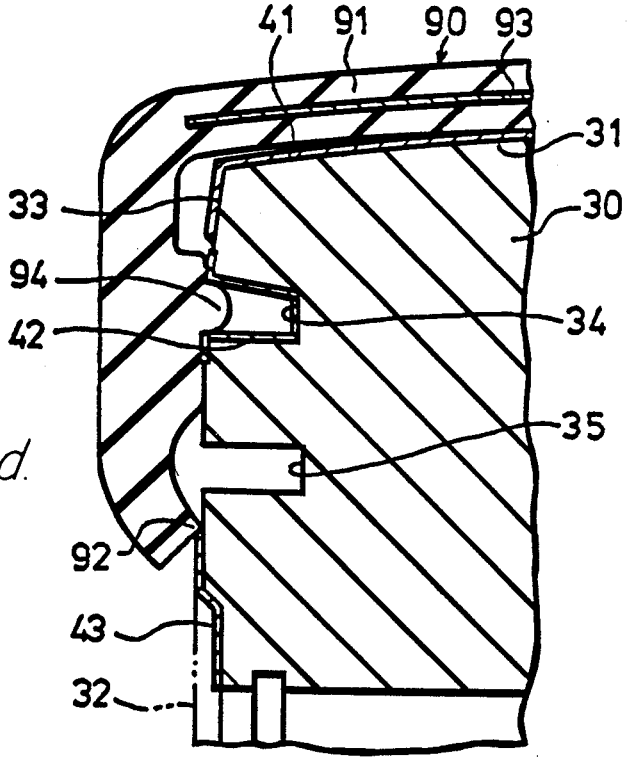

The manufacturing steps of the described piston is as follows. Referring first to FIG. 4(A), the piston 30 formed of an aluminum alloy casting is processed similar to a conventional piston so as to obtain a desired outer diameter and size. In the preferred embodiment, the circumferential surface of the piston 30 in the vicinity of the piston top 31 is machined to obtain the tapering surface 33, taking into consideration the thickness of the nickel plated layer 41 to be applied. After the machining process, a portion of the piston 30, except the piston top 31 and the tapering surface 33, is covered with a first masking jig 60 formed of a cylindrical rubber material as shown in FIG. 4(B), and is washed. Then, pretreatment such as activation for plating is carried out as required, and the piston 30 is immersed in an electroless nickel plating bath maintained at pH 4 and at a temperature of 93±2° C. to form the nickel plated layer 41 having a thickness of 20 to 30 micrometers, preferably 25±3 micrometers. If the thickness of the nickel plated layer were less than 20 micrometers, it would be too thin and less effective in the prevention of roughening of the piston top surface. On the other hand, if the layer were of adequate thickness, there would be no problem in its effectiveness for prevention of roughening. However, if the layer thickness were more than 30 micrometers, the plating time would be increased to create an undesirable increase in cost. Further, an excessive thickness of the plated layer would create an interference with the cylinder to also cause a disadvantage in this respect.

The electroless nickel plating is intended to prevent excessive thickness of the plated layer at the edge portion where the piston top 31 intersects the tapering surface 33 and thereby ensure a uniform thickness of the plated layer as a whole. However, if this shape of the edge portion is suitably designed or the edge portion is partially covered upon plating, electroless plating may be replaced by electroplating.

Figure 6:
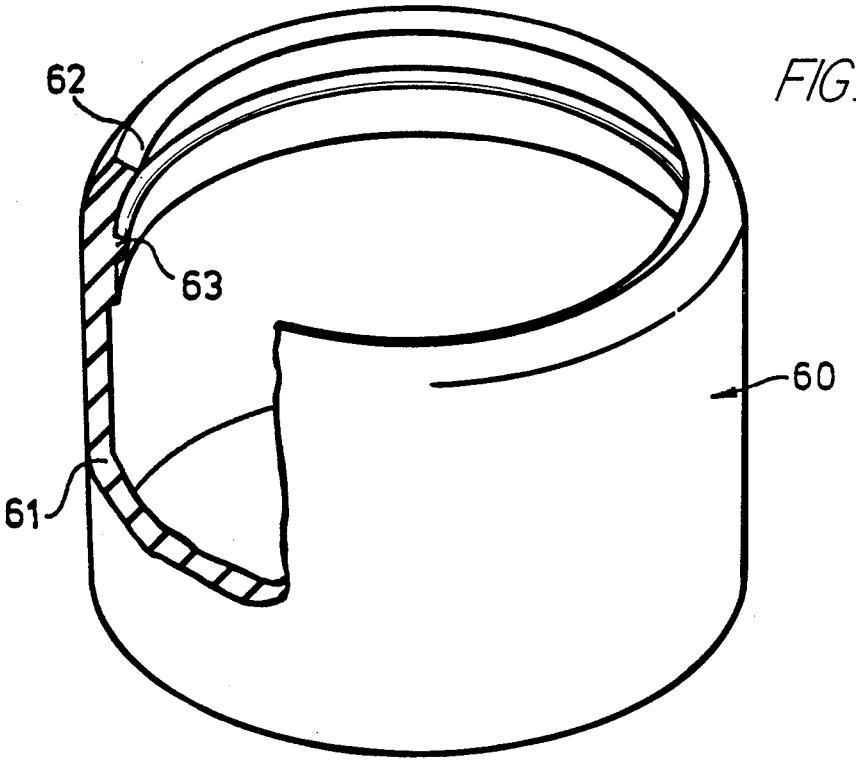
FIG. 6 is a perspective view, partly in section, of a first masking jig used in the manufacturing steps.

As shown in FIG. 6, the first masking jig 60 formed of rubber material has a cylindrical body 61. The cylindrical body 61 is integrally formed at its upper opening edge with an annular lip portion 62 to be tightly engaged with the tapering surface 33 of the piston 30 at a given distance from the top 31, so as to prevent the plating liquid from entering the area on the skirt portion 32 side. The cylindrical body 61 is integrally formed with an annular projection 63 as a jig-fixing portion to be engaged with the second ring groove 35 for positioning the lip portion 62.

Figure 4C:
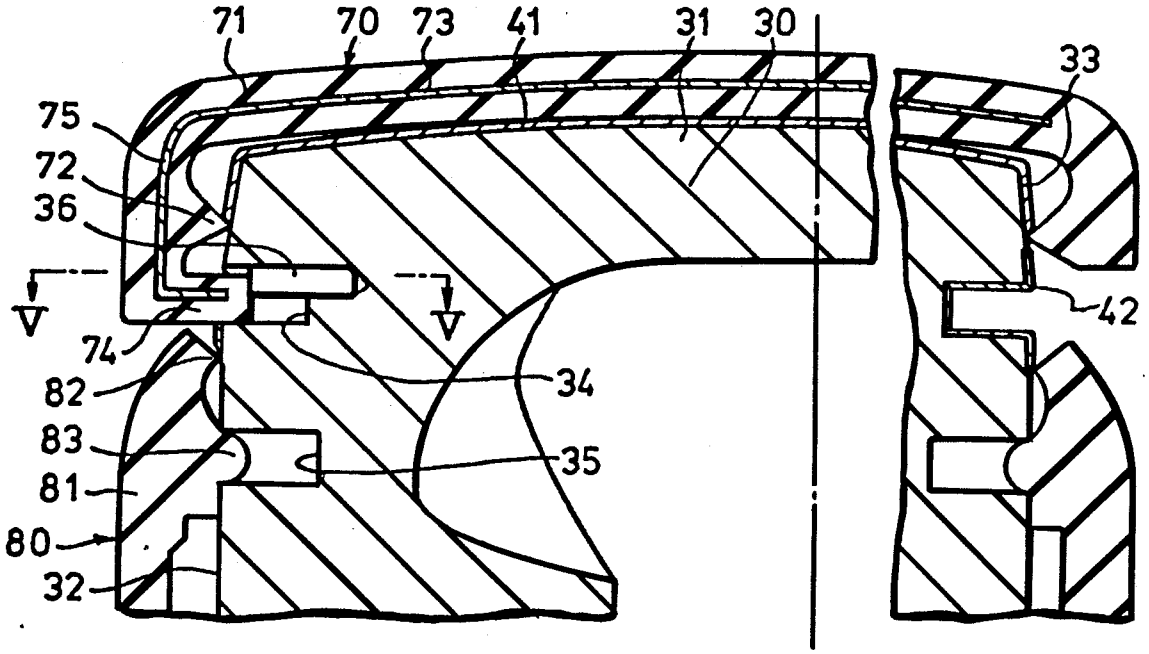

After the nickel plating step is ended, aftertreatment such as washing is carried out, and the first masking jig 60 is removed. Then, a second masking jig 70 formed of a cap-like rubber material is mounted on the piston 30 in such manner as to cover the nickel plated layer 41 as shown in FIG. 4(C). Further, a third masking jig 80 formed of a cylindrical rubber material is also mounted on the piston 30 in such manner as to cover the skirt portion 32 except in the vicinity of the top ring groove 34 as shown in FIG. 4(C). With the piston so-masked, normal pretreatment, such as washing, is carried out, and the piston 30 is then immersed in a 35% sulfuric acid bath maintained at a temperature of 0° to 5° C. for 10 to 20 minutes to thereby form by anodizing the anodized layer 42 having a thickness of about 10 micrometers.

Figure 7:
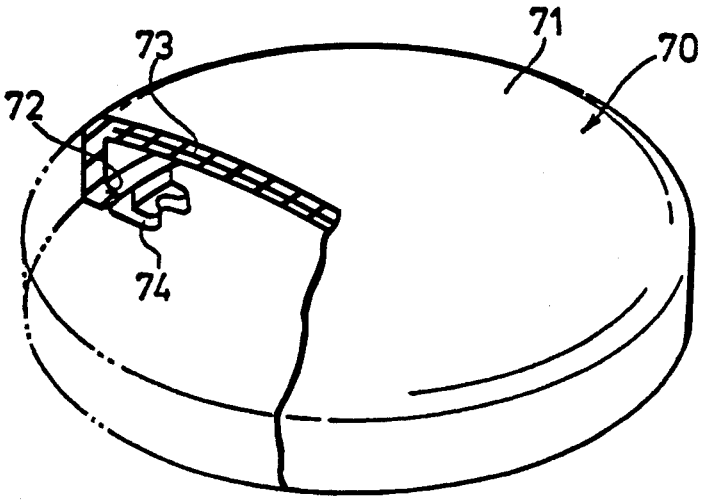
FIG. 7 is a perspective view, partly in section, of a second masking jig used in the manufacturing steps.

As shown in FIG. 7, the second masking jig 70 has a caplike body 71. The cap-like body 71 is integrally formed at its lower open edge with an annular lip portion 72 to be tightly engaged with the tapering surface 33 of the piston 30 under a given tightness, so as to prevent sulfuric acid from entering the inside of the jig 70. Further, the body 71 includes a disc-like leaf spring 73 for ensuring the positioning of the lip portion 7 by producing an enhanced abutting force against the piston top 31.

Figure 5:
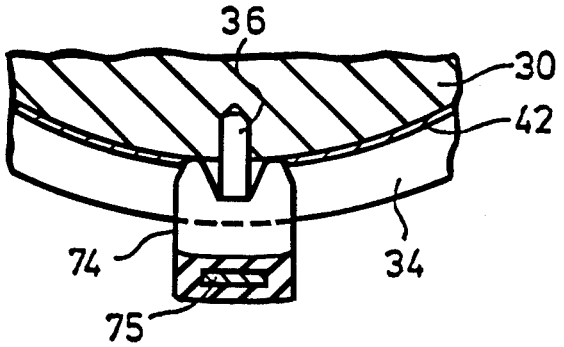
FIG. 5 is a sectional view taken along line V—V of FIG. 4(C)

In pistons for a two-cycle engine, where knock pins 36 are provided to prevent rotation of the top ring 51 and the second ring 52, the knock pins 36 are generally formed of iron and there is a possibility of their being corroded in the sulfuric acid bath. Accordingly, the body 71 can be integrally formed with a tongue portion 74 covering the pin 36 located in the top ring groove 34. As shown in FIG. 5, the tongue portion 74 includes a narrow spring metal core 75 integrally or independently extending from the leaf spring 73, so that the biasing force of the core 75 can tightly seal the periphery of the pin 36. In situations where sealing by the lip portion 72 is not sufficient because of a short longitudinal distance between the tongue portion 74 and the lip portion 72 opposed thereto, the tongue portion 74 may be cut from the lower edge of the lip portion 72 in such a manner as to extend from the outer circumference of the jig 70.

The third masking jig 80 is similar to the first masking jig 60 in that it is formed of a cylindrical rubber material and includes a cylindrical body 81 integrally formed with an annular liquid seal lip portion 82 and an annular projection 83 for fixing the jig 80. However, the third masking jig 80 differs from the first masking jig 60 in that the length from the annular projection 83 to the lip portion 82 is shorter than the corresponding length from the annular projection 63 on the first masking jig to the lip portion 62. In the case that the sealability of the lip portion 82 is insufficient because of the short distance between the lip portion 82 and the annular projection 83, the annular projection 83 to be engaged with the second ring groove 35 may, as shown in FIG. 3, be replaced by a projection to be engaged instead with the piston pin insert hole 37 of the piston 30, so as to fix the jig 80 and the position the lip portion 82.

After forming the anodized layer 42, sealing of the layer is carried out by using hot water, or the like, as required. An aftertreatment, such as washing, is then conducted whereafter the first and second masking jigs 70 and 80 are removed. In the next step, a fourth cap-like masking jig 90 is mounted on the piston 30 to cover the piston top 31 and the circumferential surface thereof to a position below the second ring groove 35. With this masking jig 90 applied, pretreatment, such as washing, is carried out and, thereafter, tin plating is conducted to form a tin plated layer 43 having a predetermined thickness at the skirt portion 32 of the piston 30. Then, aftertreatment, such as washing, is carried out and the jig 90 is removed. Thus, the final product of the piston is obtained.

The fourth masking jig 90 is similar to the second masking jig 70 in that it has a cap-like body 91 integrally formed at its lower opening edge with an annular lip portion 92 and also integrally formed with an annular projection 94 to be engaged with the top ring groove 34. The cap-like body 91 includes a disc-like leaf spring 93 for ensuring the positioning of the lip portion 92 by an enhanced abutting force against the piston top 31.

The first to fourth masking jigs 60 to 90 may be formed of special ethylene propylene rubber (EPDM) of butyl rubber from which the sulfur content in the vulcanizing agent is removed. Such a rubber material can meet the requirements that the respective jigs are required to have for adequate chemical resistance to the pretreating liquid for plating and so that the tin plated layer formed on the surface of the piston 30 will not be damaged by the jigs.

According to the preferred embodiment of the invention wherein the desired surface treatment of the piston 30 is carried out, the following effects are obtained. As the nickel plated layer 41 is formed on the surface of the piston top 31, inclusive of the tapering surface 33, heat resistance is improved because of the high melting point of nickel, i.e., about 1480° C., and damage resistance of the surface is improved due to the high Vickers hardness (Hv) of 550 attributed to the layer material. Thus, it is possible to provide sufficient durability in the piston to permit its use in high-performance engines subject to high load and severe thermal conditions. Particularly, as the peripheral edge of the piston top 31, where abnormal combustion tends to occur, is covered with the nickel plated layer 41, abnormal combustion can be effectively prevented. Further, because the outer circumferential surface of the piston top 31 is formed by the tapering surface 33, rather than by a stepped small-diameter portion the first masking jig 60 can be consistently accurately positioned on the tapering surface 33 to consistently produce a nickel plated layer 41 extending a distance L (FIG. 4(B)) from the seal provided by the lip portion 62. On the other hand, if a stepped small-diameter portion were formed on the outer circumferential surface of the piston top 31, the lip portion 62 of the masking jig 60 would tend to interfere with the stepped portion, thereby preventing accurate deposition of a layer of the length L. As a result of the latter arrangement, sufficient effectiveness for the prevention of abnormal combustion cannot be expected.

Further, as a hard anodized layer 42 is formed on the surface of the top ring groove 34, the groove is prevented from being damaged by contact with the top ring 51 at high temperature. Moreover, due to the tin plated layer 43 formed on the outer surface of the skirt portion 32 below the second ring groove 35, a smooth surface is provided to improve sliding between the skirt portion 32 and the cylinder 13 and thereby reducing sliding resistance.

In case of two-cycle engines employing iron knock pins for preventing rotation of the piston rings, the pin 36 can be tightly sealed by the tongue portion 74 of the second masking jig 70 when anodizing of the top ring groove 34 is conducted. Therefore, the knock pin 36 is prevented from being corroded by the treating liquid. In each surface treatment, the portion of the piston, except that to be treated, is sufficiently sealed by the respective first to fourth masking jigs 60 to 90. Therefore, surface treatment can be properly provided at the proper position.

Furthermore, the annular projections 63 and 83 on the first and third jigs 60 and 80, respectively, are effective for fixation of the jigs and accurate positioning of the respective lip portions 62 and 82, thereof, while in the second and fourth jigs 70 and 90, the spring leaves 73 and 93 and the annular projections 94, in the case of the fourth jig 90, are effective for fixation of the jigs and accurate positioning of the lip portions 72 and 92, respectively. Moreover, as the jigs 60 to 90 are formed of a rubber material having no adverse affect on the tin plated layer 43, there is no possibility of defective products, or the like, being produced.

Figure 8:
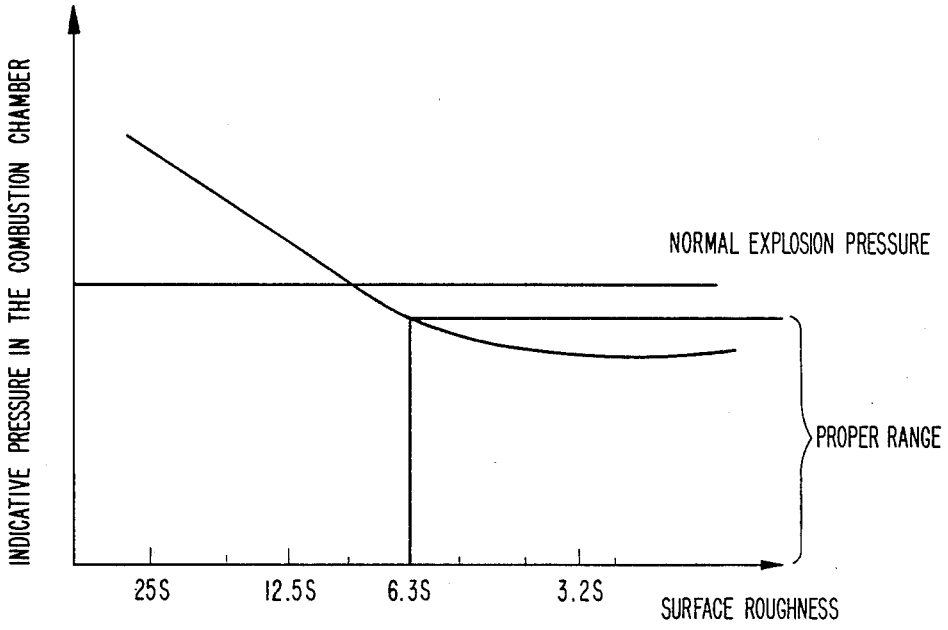
FIG. 8 is a graph illustrating the relationship between surface roughness of the piston top and the indicative pressure in the combustion chamber.

Generally, an index for detecting whether or not abnormal combustion occurs in an engine is obtained by measuring an indicative pressure in the combustion chamber 20 upon explosion. According to experiments by the present inventors, it has been found that the indicative pressure is dependent upon the surface roughness of the piston top 31. FIG. 8 shows the relation existing between surface roughness of the piston top 31 (shown by the abscissa) and the indicative pressure in the combustion chamber 20 (shown by the ordinate). As is apparent from FIG. 8, when the surface roughness is greater than 6.3 S, the indicative pressure exceeds the normal explosion pressure. Accordingly, abnormal combustion can be prevented by setting the surface roughness of the piston top 31 to be less than 6.3 S.

It is to be understood that the present invention is not limited to the embodiment of the invention described above, and that modifications capable of achieving the object may be included in the present invention. For example, although the nickel plated layer 41 in the described arrangement is formed on the entire surface of the piston top 31, it may, alternatively, be formed only on that portion of the surface of the piston top 31 opposed to the squish area 22 where abnormal combustion tends to occur, and not on the central surface of the piston top. In other words, it is sufficient that the nickel plated layer be formed only on that portion of the surface of the piston top that is subject to abnormal combustion.

Figure 9:
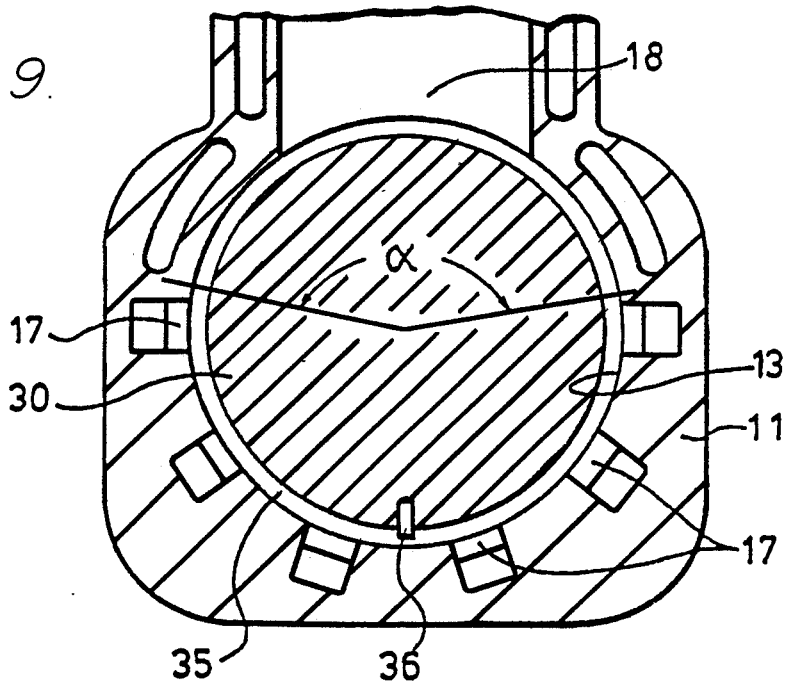
FIG. 9 is a horizontal sectional view of a two-cycle engine illustrating a second embodiment of the present invention.
Figure 10:
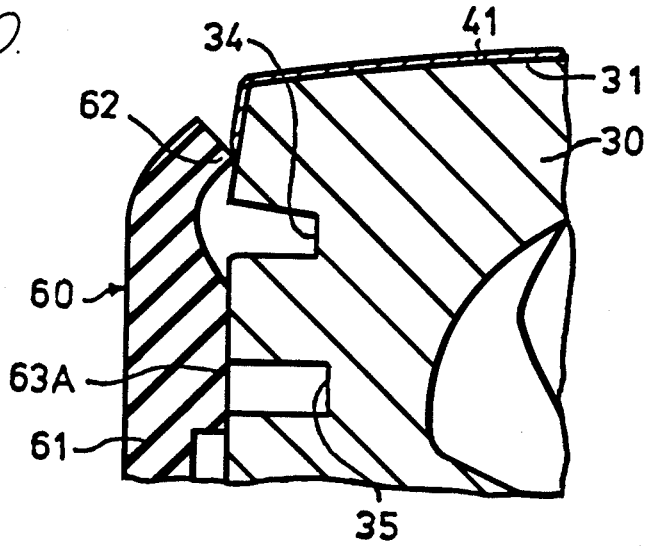
FIG. 10 is an enlarged sectional view of an essential part of a piston illustrating a third embodiment of the present invention.

Further, although the described anodized layer 42 is formed on the entire surface of the top ring groove 34, it may be formed on only at least the lower surface of the groove 34 which tends to be roughened by the ring 51. In the case of two-cycle engines, it is sufficient that the anodized layer 42 be formed on the surface of the part of the top ring groove 34 disposed adjacent the exhaust port 18 which is more prone to be subjected to hot exhaust gas, such surface portion being represented by the semicircular area corresponding to the angle $\alpha$ shown in FIG. 9. Conversely, the part of the top ring groove 34 on the opposite side of the piston from the exhaust port 18 in two-cycle engines is subject to a fuel mixture of low temperature at the scavenging port 17, and the temperature of this piston portion is, therefore, not so high. Accordingly, the anodizing need not be carried out at the piston portion in the area of the scavenging port 17.

In the case of four-cycle engines, the piston rings are normally rotatable in order to permit heat to be radiated therethrough. Consequently, thermal conditions are less severe than those in two-cycle engines and the area of the anodized layer may, therefore, be smaller than that for two-cycle engines.

Further, although the positioning of the lip 62 of the first masking jig 60 and the fixation of the jig 60 to the piston 30 are ensured by the annular projection 63 that is engaged with the second ring groove 34, the annular projection 63 may be replaced by a jig fixing portion 63A that is tightly engaged with the outer circumference of the piston 30 under a given pressure. In this case, the position of the lip portion 62 may be carried out by setting a depth of engagement of the masking jig 60 with the piston 30 through the use of an additional positioning jig. It will, therefore, be understood that such a fixing jig portion 63A may be equally applied to the other masking jigs 70, 80 and 90.

It should be further understood that, although the preferred embodiments of the invention have been illustrated and described herein, changes and modifications can be made in the described arrangements without departing from the scope of the appended claims.

We claim:

1. A piston head for operation in a combustion chamber of an internal combustion engine, which combustion chamber is formed to define a squish area in cooperation with said piston head, the cooperating region of said piston head being subject to generation of surface roughness due to excessive thermal conditions and in which said piston head is formed of a generally cylindrical skirt portion, a top surface containing said squish area at one end and a conically tapered annular surface intermediate said skirt portion and said top surface, and in which a heat resisting treated layer is applied only to the surface of said piston head that cooperates with said combustion chamber to form said squish area.

2. The piston head according to claim 1 in which said heat resisting treated layer is a nickel plated layer deposited on said conically tapered annular surface and said top surface.

3. The piston head according to claim 2 in which said nickel plated layer is polished to a mirror finish.

4. The piston head according to claim 2 in which said nickel plated layer has a substantially uniform thickness.

5. The piston head according to claim 4 in which said nickel plated layer has a thickness of from about 20 micrometers to about 30 micrometers.

6. The piston head according to claim 5 in which said nickel plated layer has a thickness of from about 22 micrometers to about 28 micrometers.

7. A piston head for operation in a combustion chamber of an internal combustion engine, said chamber being formed to define a squish area in cooperation with said piston head subject to generation of surface roughness due to excessive thermal conditions therein comprising a heat resisting treated layer applied only to the surface of said piston head cooperating with said combustion chamber to form said squish area.

8. The piston head according to claim 7 comprising:

a body having a top surface defining a crown and a generally cylindrical side extending therefrom;

one or more annular grooves formed in said cylindrical side axially spaced from said crown for reception of piston rings;

a nickel plated heat resisting layer formed on the surface of said crown that cooperates with said combustion chamber to form said squish area; and an anodic oxide coating formed by anodizing on the cylindrical sides of said body including said grooves.

9. A piston for an internal combustion engine according to claim 8 in which said nickel plated layer and said anodic oxide coating extend substantially continuously in the axial direction between said crown and at least one of said grooves.

10. A piston head for operation in a combustion chamber of an internal combustion engine, said chamber in cooperation with said piston head being formed to define a squish area subject to generation of surface roughness due to excessive thermal conditions therein comprising a heat resisting treated layer applied only to the surface of said piston head cooperating with said combustion chamber to form said squish area, said heat resisting layer being polished to a mirror finish.

11. The piston head according to claim 10 in which said heat resisting layer is a nickel plated layer.

12. A piston for an internal combustion engine comprising:

a body forming a piston head having a top surface defining a crown and a generally cylindrical side extending therefrom, one or more annular grooves formed in said cylindrical side axially spaced from said crown for reception of piston rings;

means forming a radially extending opening in said body at least partially communicating with said grooves;

a metal pin received in said opening and extending at least partially into said grooves to prevent rotation of a piston ring therein;

a nickel plated heat resisting layer formed at least on the surface of said crown;

an anodic oxide coating formed by anodizing on the cylindrical sides of said body including said grooves; and the region of said grooves surrounding said opening being devoid of said anodic oxide coating.

* * * * *